US012397190B2

(12) United States Patent
Wineman

(10) Patent No.: US 12,397,190 B2
(45) Date of Patent: Aug. 26, 2025

(54) GLIDER GLOVES

(71) Applicant: Pvolve, LLC, New York, NY (US)

(72) Inventor: Stephanie Wineman, Birmingham, MI (US)

(73) Assignee: Pvolve, LLC

( * ) Notice: Subject to any disclaimer, the term of this patent is extended or adjusted under 35 U.S.C. 154(b) by 75 days.

(21) Appl. No.: 18/457,173

(22) Filed: Aug. 28, 2023

(65) Prior Publication Data

US 2025/0073525 A1 Mar. 6, 2025

(51) Int. Cl.
*A63B 21/00* (2006.01)

(52) U.S. Cl.
CPC ..... *A63B 21/4043* (2015.10); *A63B 21/4034* (2015.10)

(58) Field of Classification Search
CPC ..... A63B 21/0004; A63B 21/4034; A63B 21/4035; A63B 21/4043
See application file for complete search history.

(56) References Cited

U.S. PATENT DOCUMENTS 5,209,490 A * 5/1993 Dallavecchia ..... A63B 59/20 446/46
8,382,645 B2 * 2/2013 Mylrea ..... A63B 21/4033 482/79
8,480,547 B2 * 7/2013 Coates ..... A63B 23/03541 482/141
9,011,294 B2 * 4/2015 Mylrea ..... A63B 22/20 482/51
9,132,316 B2 * 9/2015 Lima ..... A63B 21/4035
9,623,273 B1 * 4/2017 Chen ..... A63B 21/4034
10,773,119 B2 * 9/2020 Cheng ..... A63B 23/1236
10,933,278 B2 * 3/2021 Moridaira ..... A63B 22/20
11,260,264 B2 * 3/2022 Richter ..... A63B 21/4021
11,607,579 B2 * 3/2023 Elpers ..... A63B 21/4035
11,684,817 B2 * 6/2023 Clanton ..... A63B 22/20 482/139
2007/0287605 A1 * 12/2007 Mylrea ..... A63B 21/4034 482/92
2010/0317496 A1 * 12/2010 Abranchess ..... A63B 23/0405 482/141
2013/0252791 A1 * 9/2013 Chang ..... A63B 23/0222 482/132
2013/0345033 A1 * 12/2013 Peck ..... A63B 21/0618 482/142
2015/0111705 A1 * 4/2015 Walker ..... A63B 23/0211 482/66
2015/0224356 A1 * 8/2015 Holland ..... A63B 5/20 482/66
2017/0072259 A1 * 3/2017 Trenkle ..... A63B 21/012
(Continued)

OTHER PUBLICATIONS

Floor Glider Exercise Disks; https://www.pvolve.com/products/gliders-teal; retrieved Aug. 28, 2023, 4 Pages.
(Continued)

*Primary Examiner* — Joshua Lee
(74) *Attorney, Agent, or Firm* — Foley & Lardner LLP

(57) ABSTRACT

An exercise device includes a glider and a glove that covers at least a portion of the glider. The glove includes a grip disposed on an inner surface of the glove that engages with the glider. The glider and the glove can slide along a surface responsive to a force applied to the glider.

16 Claims, 24 Drawing Sheets

(56) References Cited

U.S. PATENT DOCUMENTS

| | | | | |
|---|---|---|---|---|
| 2019/0358482 | A1* | 11/2019 | Huneau | A63B 21/0004 |
| 2020/0215379 | A1* | 7/2020 | Stryska | A63B 21/4037 |

OTHER PUBLICATIONS

Glider Gloves for Floor Protection; https://www.pvolve.com/products/glider-gloves; retrieved Aug. 28, 2023, 3 Pages.
Floor Glider Exercise Disks; https://www.pvolve.com/products/gliders-teal; 4 Pages.
Glider Gloves for Floor Protection; https://www.pvolve.com/products/glider-gloves; 3 Pages.

* cited by examiner

GLIDER GLOVES

BACKGROUND

The present disclosure relates generally to exercise devices for exercising the upper and lower body of a user. More particularly, the present disclosure relates to an exercise device in which a user can add fluidity and versatility to exercise movements by reducing friction between the user (e.g., a user's foot) and a surface. This type of training may allow the user to create deeper muscle engagement during exercise.

Traditional exercise equipment is typically intended to target a specific muscle group and may also require auxiliary equipment in order to complete various exercises. Traditional exercise equipment may also present various challenges and dangers to users. For example, a user performing exercises outside of a gym setting may require certain equipment to activate specific muscle movement. Further, a user training with various exercise equipment outside of a gym setting (e.g., at home) may risk damaging areas of their home by using the equipment.

Traditional exercise equipment may also be intended for use in a specific range of motion or performing a specific exercise. As such, a user intending to engage in training one or more muscle groups using multiple exercises and/or ranges of motion faces the challenge of using multiple different types of exercise equipment. In some instances, a user may implement a training technique intended to minimize rest time between exercises, which presents a challenge when multiple types of different exercise equipment are required and may require set-up or other assistance prior to use, thus interrupting such a training technique.

Therefore, an exercise device that addresses one or more of the aforementioned challenges may be desired.

SUMMARY

One embodiment relates to an exercise device. The exercise device includes a glider and a glove that covers at least a portion of the glider. The glove includes a grip disposed on an inner surface of the glove that engages with the glider. The glider and the glove can slide along a surface responsive to a force applied to the glider.

Another embodiment relates to a glove that covers a glider. The glove includes a grip disposed on an inner surface of the glove. The grip engages with the glider. The glider and the glove can slide along a surface responsive to a force applied to the glider.

Another embodiment relates to a method of using an exercise device. The method includes providing the exercise device including a first glider, a first glove, a second glider, and a second glove. The method includes placing the first glove over the first glider, placing the second glove over the second glider, and applying a force to move at least one of the first glider or the second glider along a surface. The first glove includes a first grip disposed on an inner surface of the first glove to fix the first glider relative to the first glove. The second glove includes a second grip disposed on an inner surface of the second glove to fix the second glider relative to the second glove.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, an exercise device described herein allows a user to easily and safely exercise in various settings (e.g., at a gym, at home, etc.). The exercise device includes at least one glider having at least one surface formed of a hard material (e.g., plastic) capable of gliding along a soft surface (e.g., carpet). A user can step on the glider at the ball of their foot, or another portion of the user, to add fluidity and versatility in exercise movements along the soft surface (e.g., such that the user can slide their feet along the surface with reduced or minimal friction). The exercise device includes at least one glove that can at least partially surround and/or enclose the glider. The glove can be formed of a soft fabric material (e.g., fleece, cotton, etc.) such that the glove surrounding the glider can allow the glider to slide along a hard surface (e.g., wood flooring, tile flooring, etc.) with minimal or reduced friction in comparison to the surface of the glider. Therefore, the exercise device allows a user to engage in various deep muscle engagement exercises in a variety of settings including, but not limited to, soft floor settings (e.g., carpet flooring, rugs, etc.), and/or hard floor settings (e.g., hard wood flooring, tile flooring, vinyl flooring, etc.). The one or more gloves of the exercise device can include at least one grip on the inner surface of the exercise device to engage with the glider and fix the glider relative to the glove such that the glove does not slide off when a user uses the glider and glove.

Figure 1:
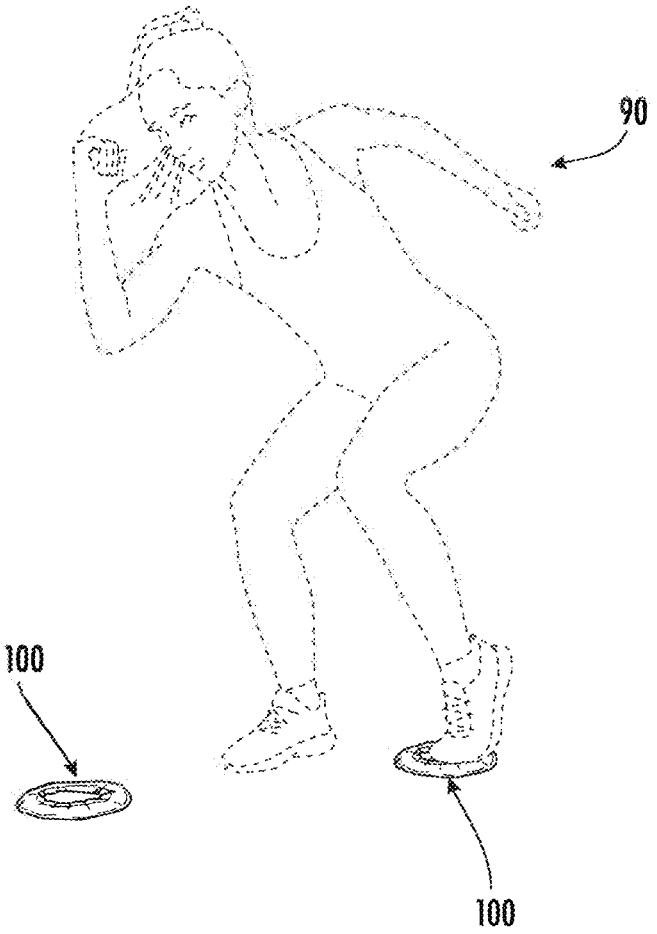
FIG. 1 is an illustration of a user using exercise devices, according to an exemplary embodiment.

Referring to FIG. 1, an exercise device 100 can be used by a user 90 to exercise. For example, as described herein, the exercise device 100 can include a slidable glider that a user 90 can step on (e.g., with one or more feet). A user 90 can push on the exercise device 100 to cause the exercise device 100 to slide over a surface (e.g., the ground, a floor, etc.). The exercise device 100 can slide to allow the user 90 to perform various exercises including, but not limited to, stationary running, lunges, planks, push-ups, stationary climbing, or other movements without the user 90 having to take their feet off the exercise device 100. Such movements can facilitate adding fluidity and versatility to exercise movements by reducing friction between the user 90 (e.g., a user's foot or hand) and a surface. This type of training may allow the user 90 to create deeper muscle engagement during exercise.

Figure 2:
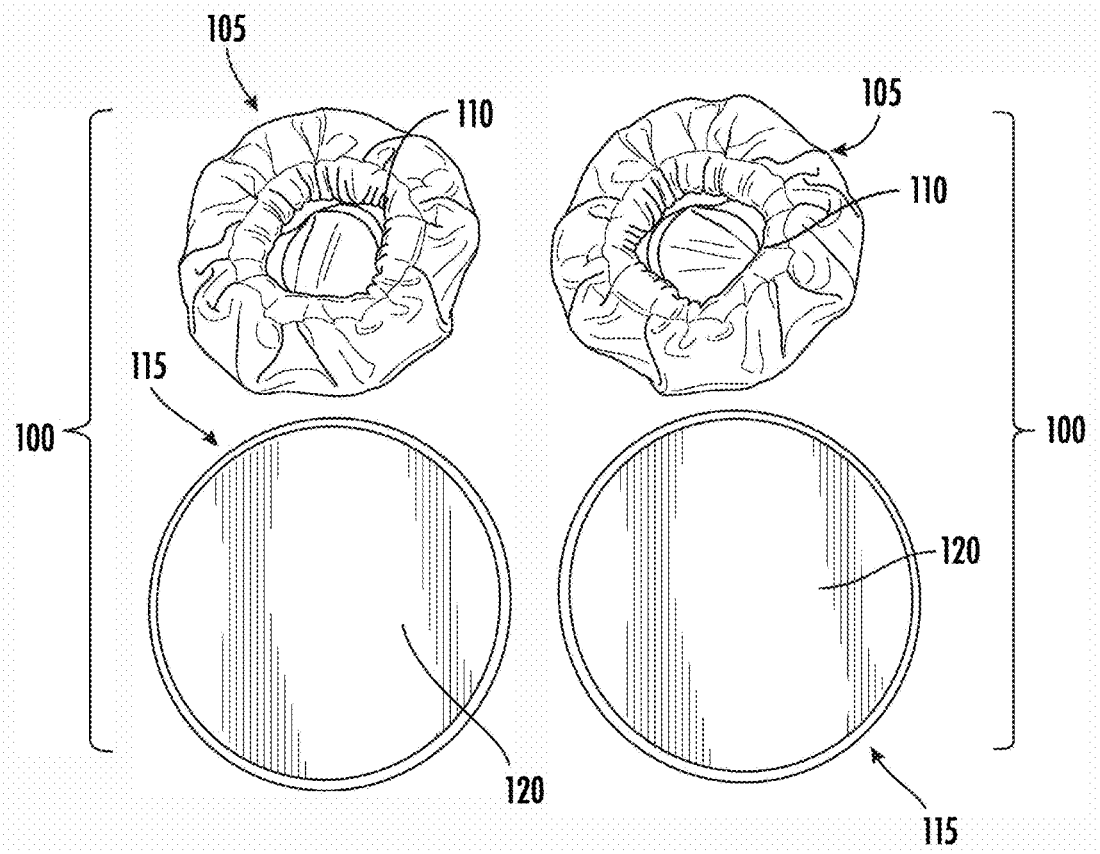
FIG. 2 is an exploded view of the exercise devices of FIG. 1, according to an exemplary embodiment.
Figure 3:
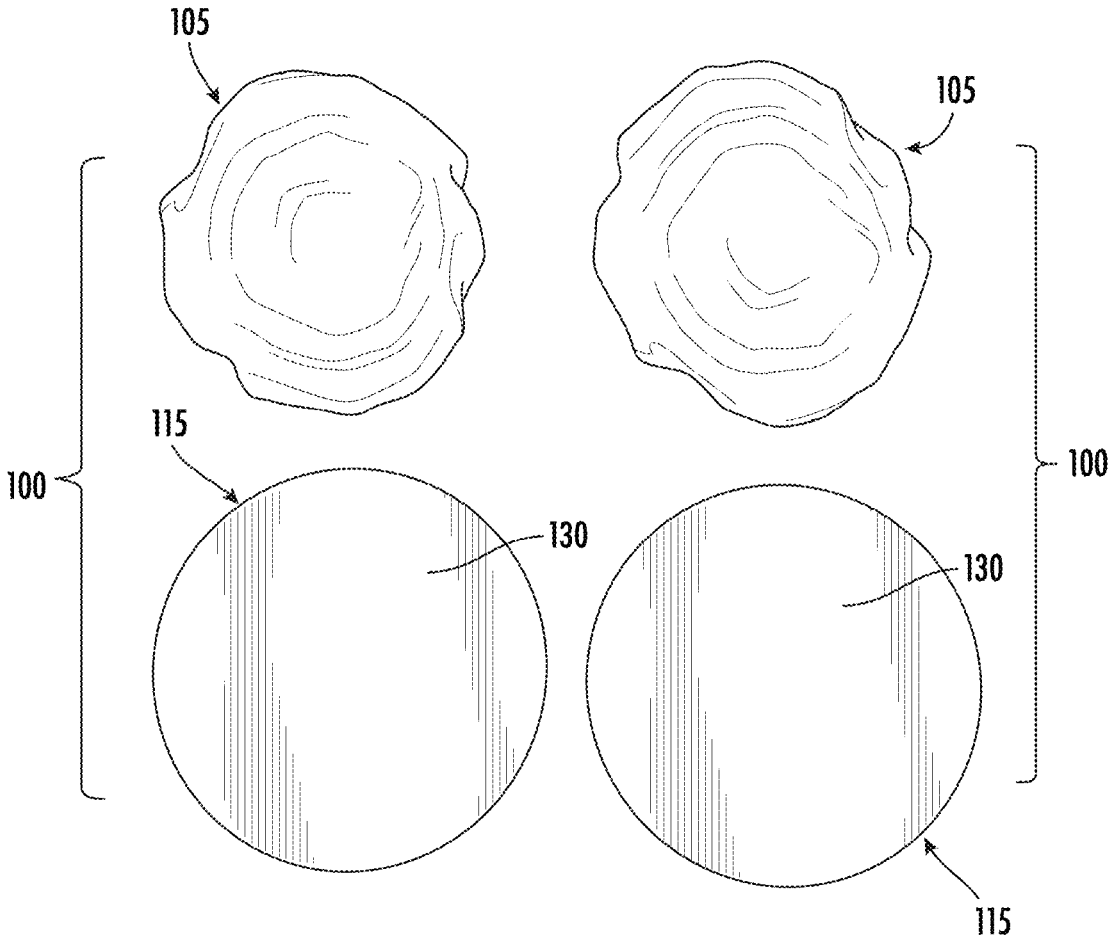
FIG. 3 is another exploded view of the exercise devices of FIG. 1, according to an exemplary embodiment.
Figure 4:
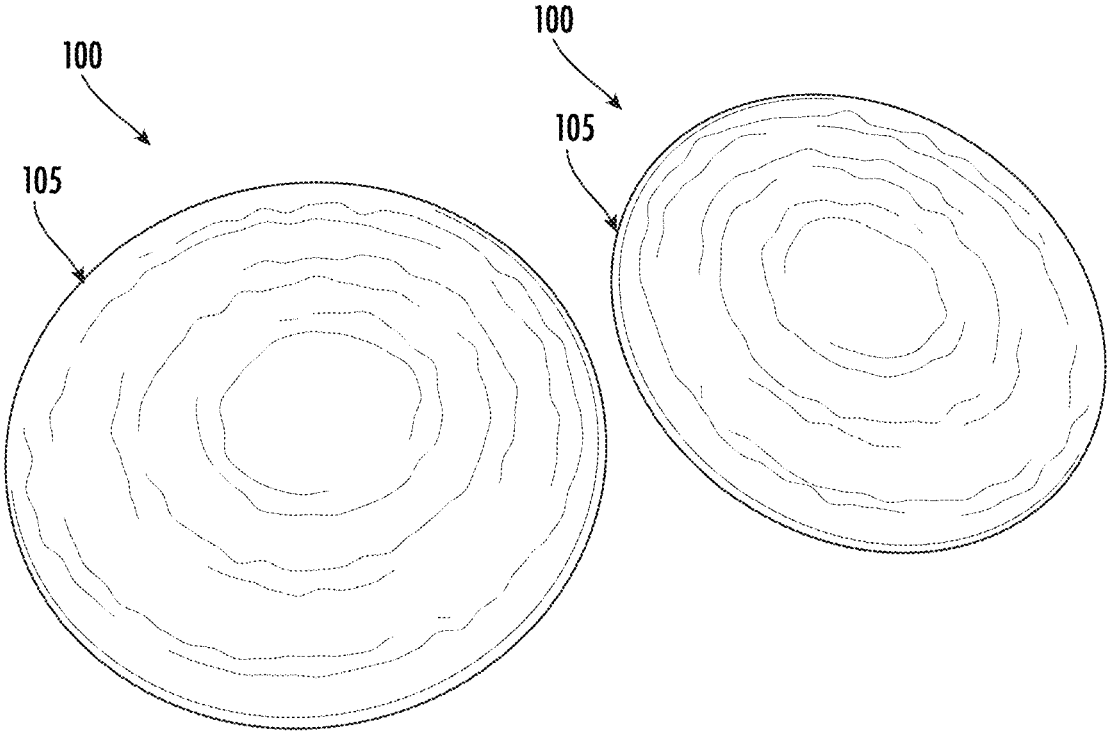
FIG. 4 is a bottom view of the exercise devices of FIG. 1, according to an exemplary embodiment.
Figure 5:
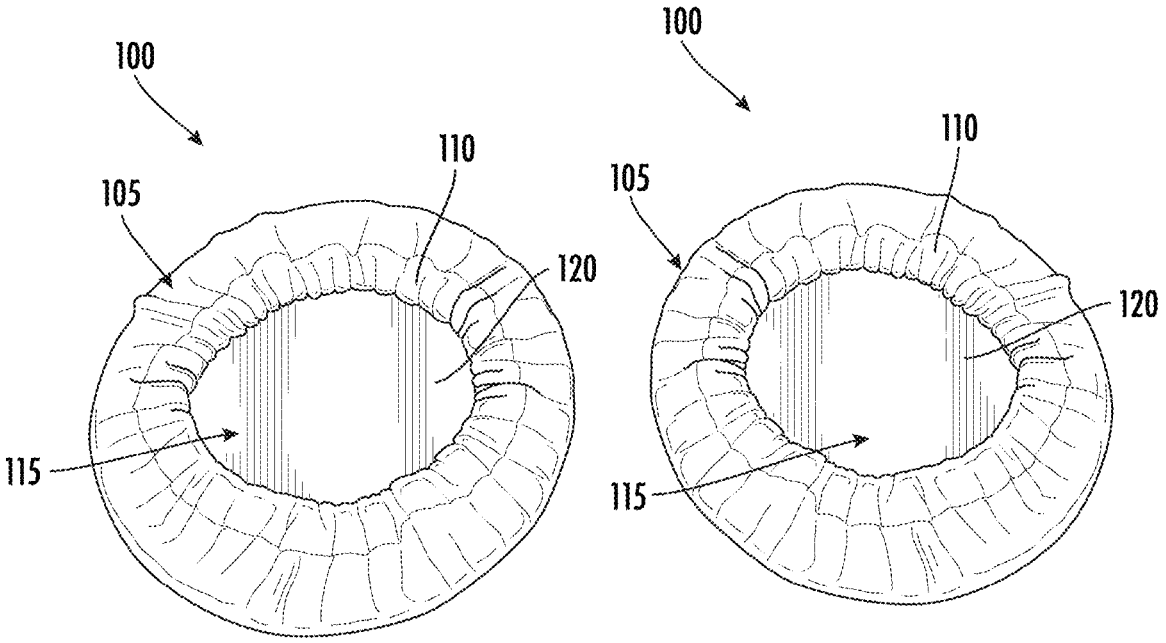
FIG. 5 is a top view of the exercise devices of FIG. 1, according to an exemplary embodiment.

FIGS. 2-5 depict various views of a set of exercise devices 100. For example, FIG. 2 depicts a partially exploded top view of a pair of exercise devices 100 (e.g., a first exercise device 100 and a second exercise device 100), FIG. 3 depicts a partially exploded bottom view of the pair of exercise devices 100, FIG. 4 depicts a bottom view of the pair of exercise devices 100, and FIG. 5 depicts a top view of the pair of exercise devices 100. As depicted, each exercise device 100 includes a glider 115 and a glove 105 that can couple with the glider 115. For example, the glider 115 can fit within the glove 105 such that the glove 105 covers at least one side of the glider 115.

The glider 115 includes a first surface 120 and an opposing second surface 130. The first surface 120 and/or the second surface 130 may be at least partially curved (e.g., not planar) to facilitate receiving a portion of the user 90 (e.g., a ball of a user's foot). The first surface 120 can include one or more materials that facilitate gripping a portion of a user 90 to use the glider 115. For example, the first surface 120 can be made at least partially of one or more foam materials (e.g., Ethylene-Vinyl Acetate (EVA), polyurethane foam, etc.) to facilitate gripping a portion of the user 90 (e.g., a body part such as a hand, knee, or foot, or an article of clothing such as a sock, shoe, etc.). The first surface 120 can be made from various other materials including, but not limited to, plastic, rubber, or metal.

The second surface 130 can include one or more materials that have a lower coefficient of friction on soft floors (e.g., carpet rugs, etc.) than the material of the first surface 120 of the glider 115. For example, the second surface 130 can be made of one or more hard plastics (e.g., acrylonitrile butadiene styrene (ABS), polypropylene (PP), polyvinyl chloride (PVC), etc.). In other words, the second surface 130 can be formed of one or more materials that are slidable on soft flooring, such as carpet, rugs, or other soft floors.

With this configuration, a user 90 can place at least one glider 115 on a soft floor (e.g., carpet or rug) with the second surface 130 facing the floor and the first surface 120 opposing the floor. The user 90 can step on the first surface 120 (e.g., via a foot, knee, hand, etc.) and can apply a force on the glider 115 such that the glider 115 can easily slide along the soft flooring surface by the smooth second surface 130 of the glider 115 while a user's foot, knee, hand, or other portion touching the second surface 130 can maintain engaged with (e.g., in contact with) the first surface 120 to perform various exercises described herein.

To use the glider 115 on hard flooring (e.g., wood, vinyl, tile, laminate, etc.), the glider 115 can be at least partially placed into a corresponding glove 105. For example, the glove 105 can include at least one opening 110 on a first side of the glove 105. The opening 110 can receive the glider 115 such that the glove 105 can at least partially or substantially cover the glider 115. For example, the glove 105 can cover an entirety of the second surface 130 of the glider 115 and/or at least a portion of the first surface 120 of the glider 115. In some implementations, at least a portion of the first surface 120 can be exposed to an external portion of the glove 105, as depicted in at least FIG. 5, such that the gripping material of the first surface 120 is at least partially exposed for the user 90 to grip the exercise device 100. In some implementations, the glove 105 may enclose the entire glider 115, or substantially the entire glider 115.

The opening 110 can be smaller in diameter or width than the glider 115 in at least one direction to facilitate surrounding the glove 105. For example, the opening 110 can include at least one elastic material (e.g., elastic band integrated within the material of the glove 105) that allows the opening 110 to stretch open to receive the entire glider 115. The elastic band can facilitate biasing the opening 110 at least partially closed once the glider 115 is placed into the glove 105 to facilitate preventing the glider 115 from falling out of the glove 105. In some implementations, the opening 110 may include a shape that substantially matches a shape of the glider 115. In some implementations, the opening 110 may include a different shape or profile than the glider 115.

The glove 105 can include one or more soft fabric materials to facilitate allowing the glider 115 to slide along a hard surface (e.g., wood, vinyl, tile, etc.) with less force as compared to the second surface 130 of the glider 115 sliding along the same hard surface while reducing or eliminating the risk of scratching the hard surface. For example, the glove 105 can be formed of various fabrics including, but not limited to, fleece, cotton, neoprene, polyester, velvet, or other materials that allow the glider 115 to slide along hard flooring. In other words, at least one material of the glove 105 can include a lower coefficient of friction against a hard flooring surface as compared to the coefficient of friction of the second surface 130 of the glider 115 to facilitate allowing the glider 115 to slide against the hard flooring surface.

Figure 6:
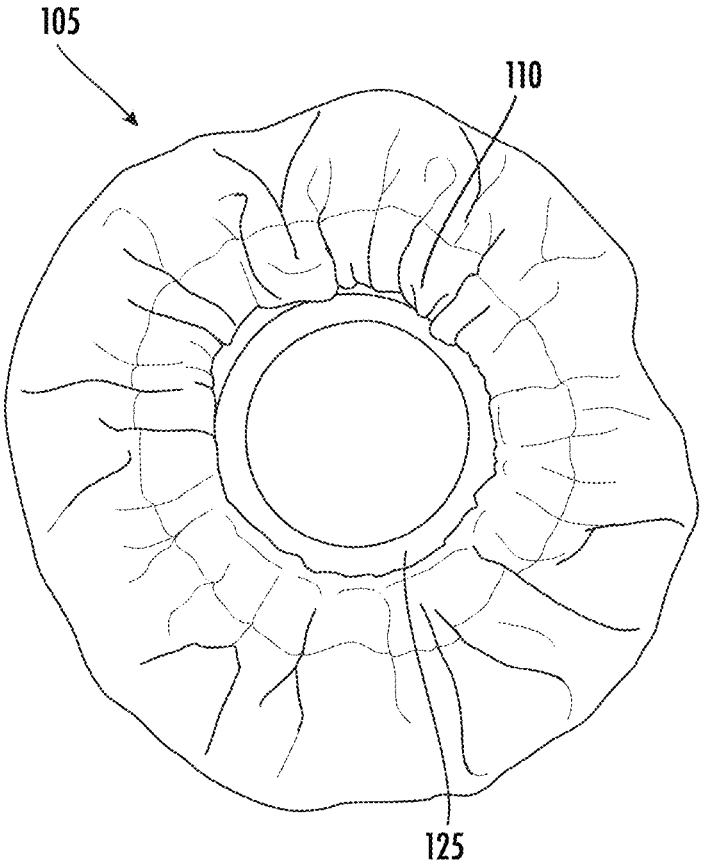
FIG. 6 is a top view of a glove of an exercise device of FIG. 1, according to an exemplary embodiment.
Figure 7:
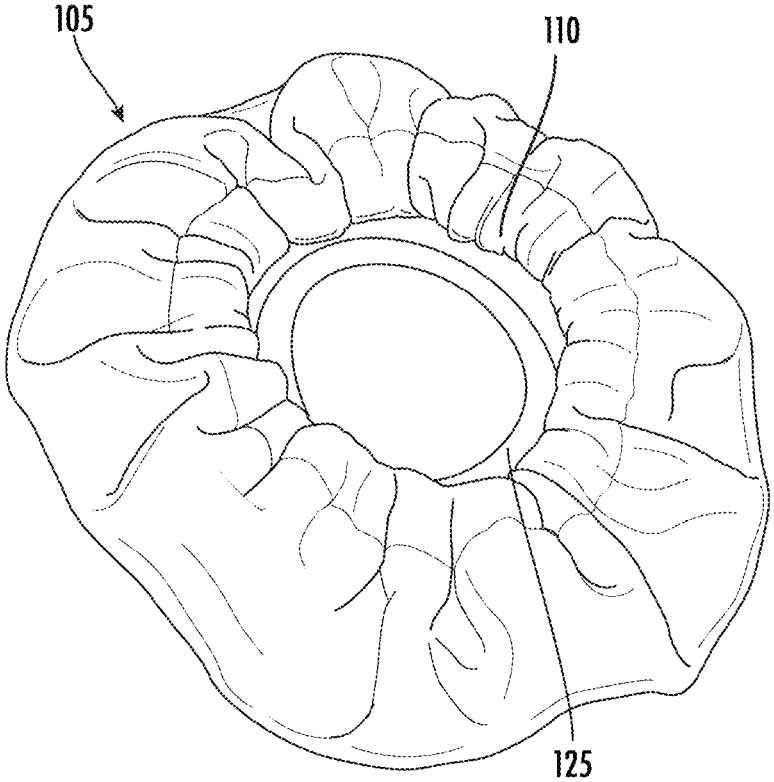
FIG. 7 is a top perspective view of the glove of FIG. 6, according to an exemplary embodiment.
Figure 8:
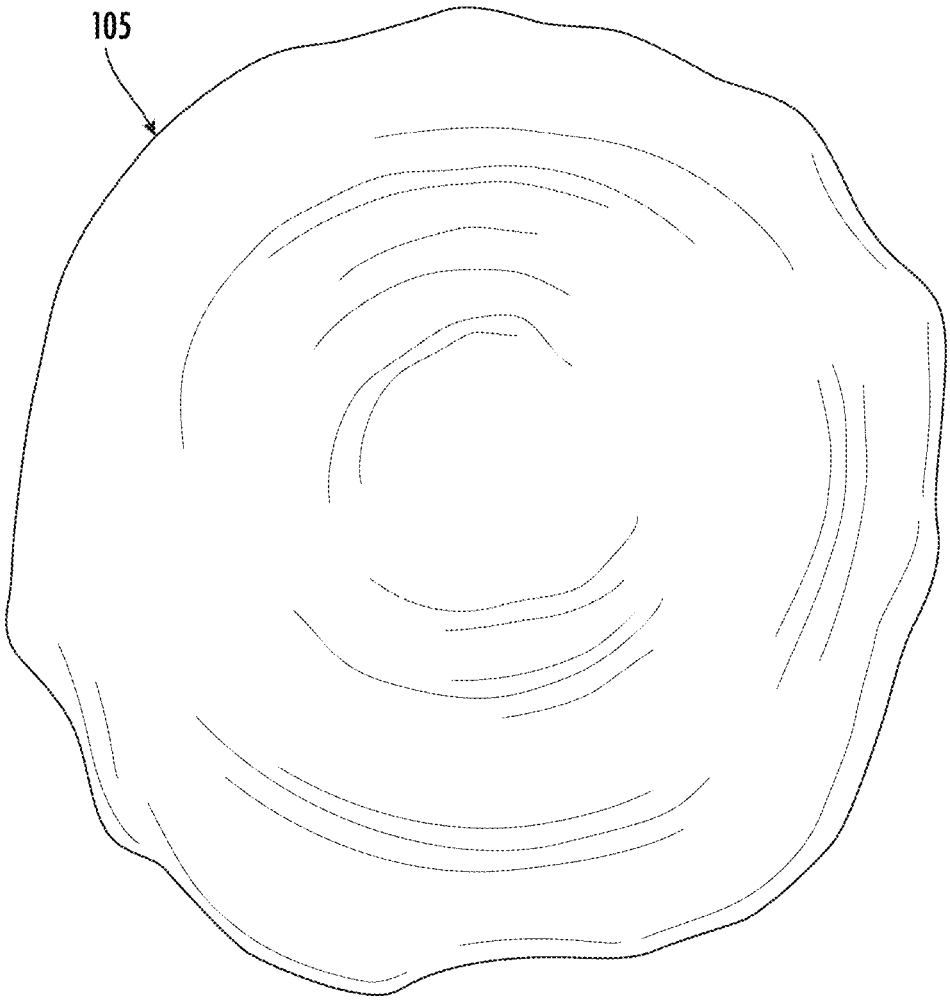
FIG. 8 is a bottom view of the glove of FIG. 6, according to an exemplary embodiment.
Figure 9A:
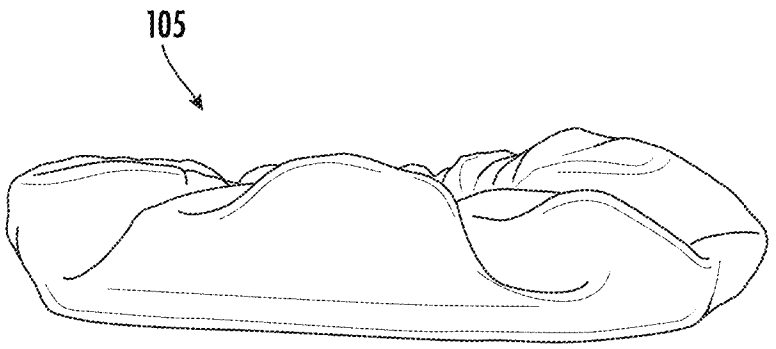
FIGS. 9A-9D are side views of the glove of FIG. 6, according to an exemplary embodiment.
Figure 9B:
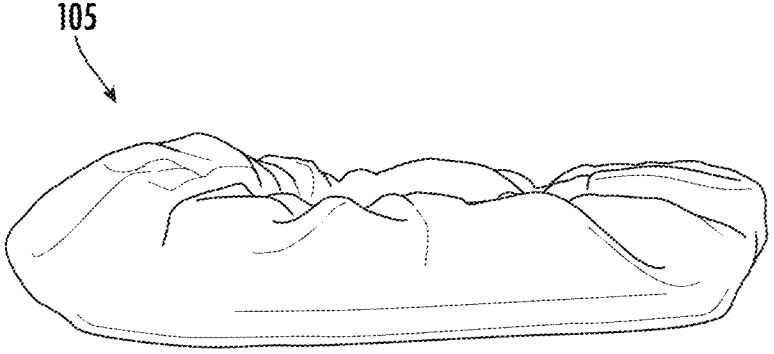
Figure 9C:
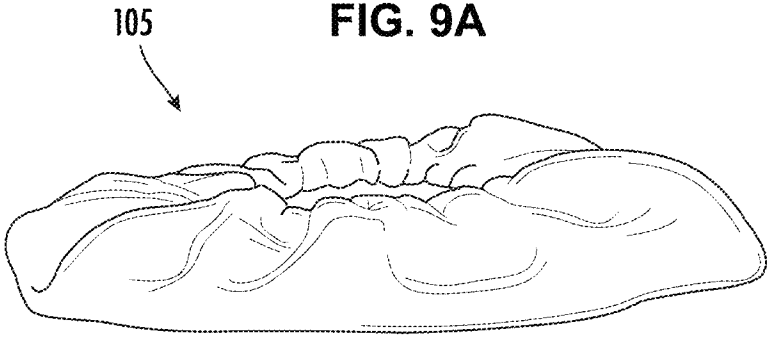
Figure 9D:
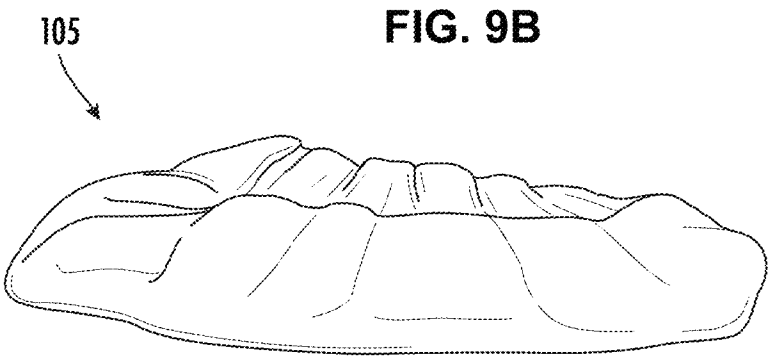
Figure 10:
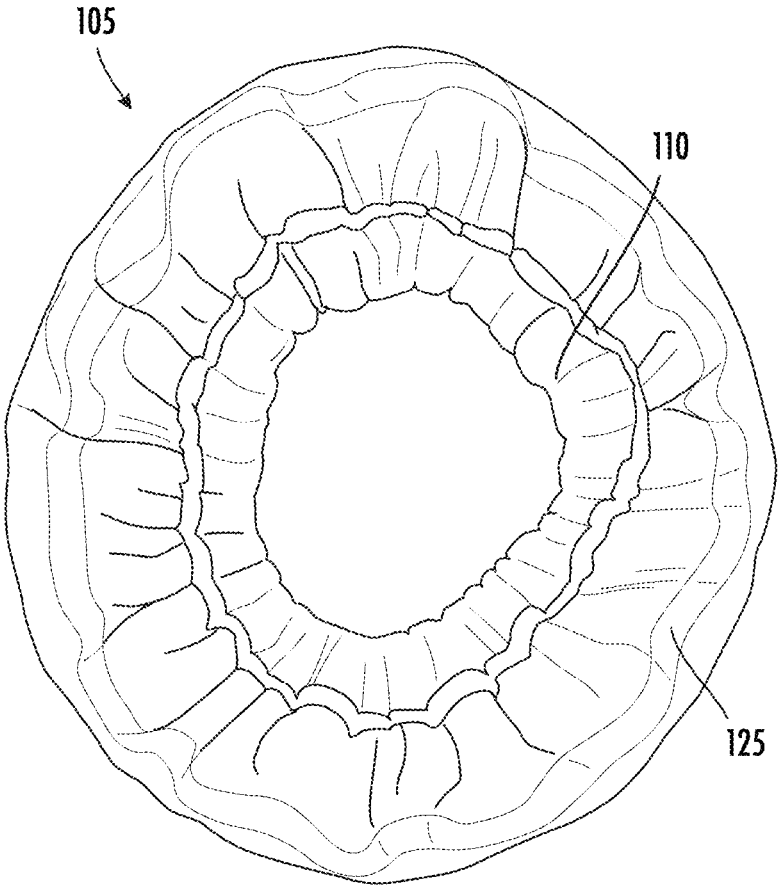
FIG. 10 is a bottom view of the glove of FIG. 6 in an inside-out state, according to an exemplary embodiment.
Figure 11:
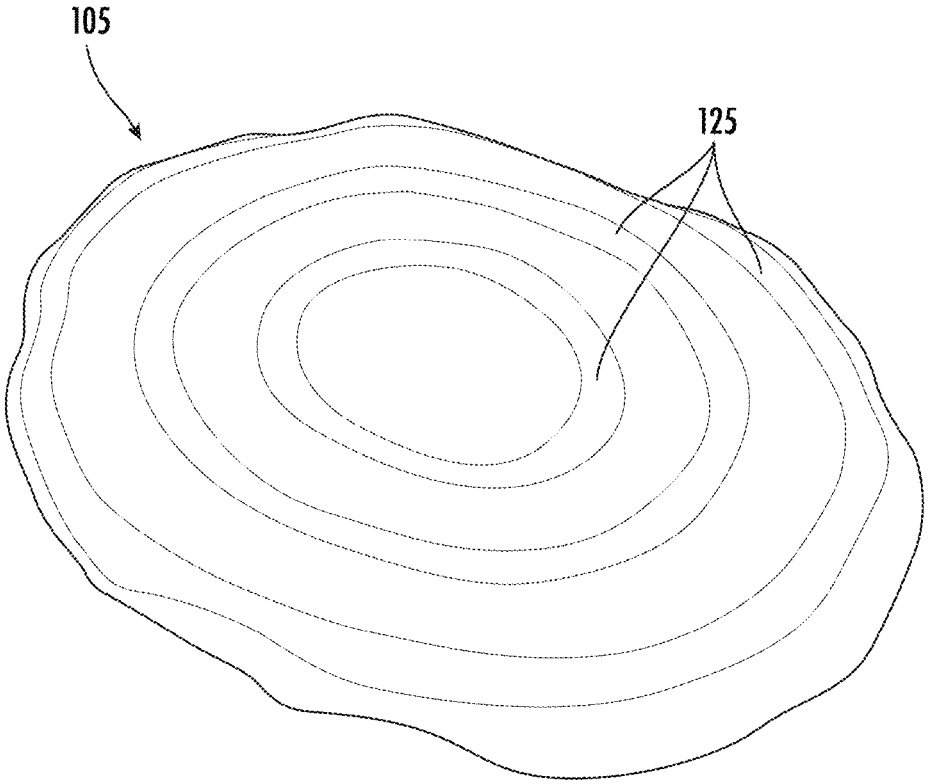
FIG. 11 is a top perspective view of the glove of FIG. 6 in an inside-out state, according to an exemplary embodiment.
Figure 12:
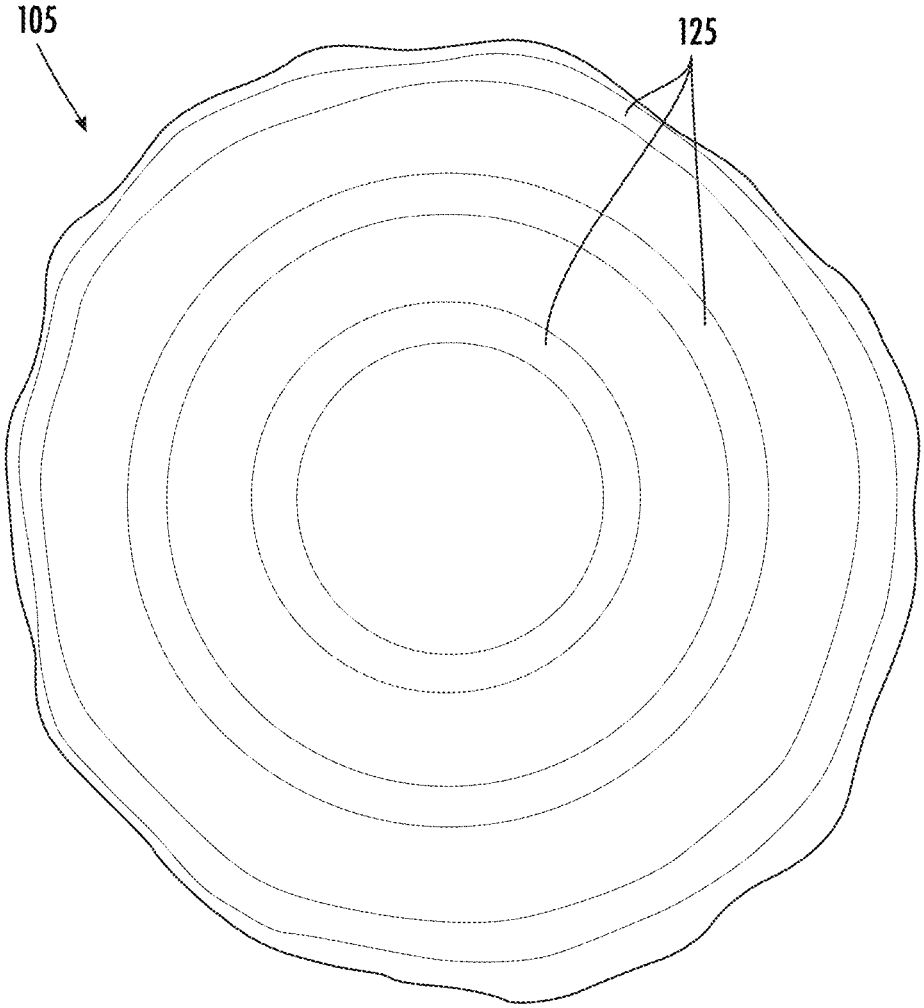
FIG. 12 is a top view of the glove of FIG. 6 in an inside-out state, according to an exemplary embodiment.
Figure 13A:
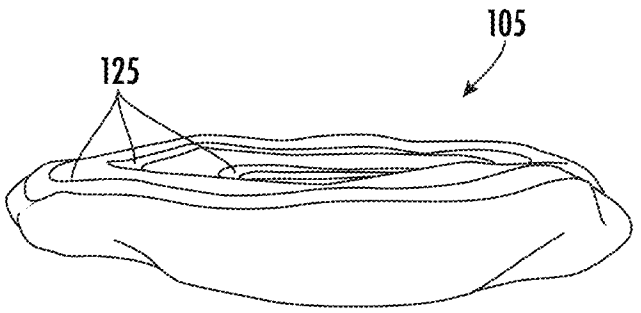
FIGS. 13A-13D are side views of the glove of FIG. 6 in an inside-out state, according to an exemplary embodiment.
Figure 13B:
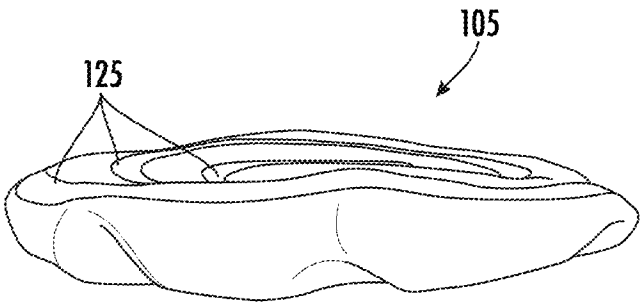
Figure 13C:
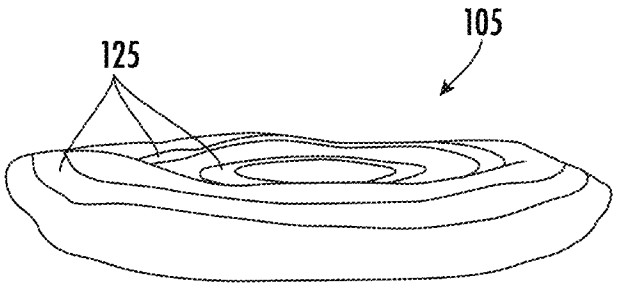
Figure 13D:
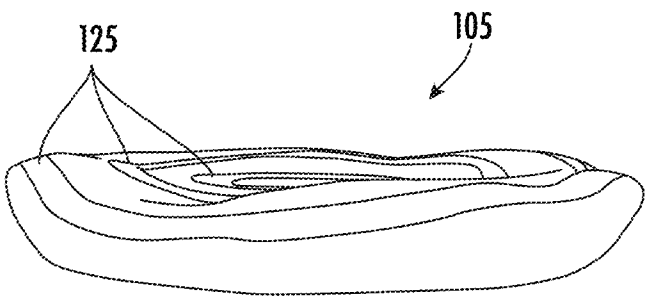

FIGS. 6-9D depict various views of the glove 105 and FIGS. 10-13D depict various views of the glove 105 in an inside-out state (e.g., flipped inside-out at the opening 110 such that the inner surface of the glove 105 is facing outward). For example, FIG. 6 depicts a top view of the glove 105, FIG. 7 depicts a top perspective view of the glove 105, FIG. 8 depicts a bottom view of the glove 105, and FIGS. 9A-9D depicts various side views of the glove 105. FIG. 10 depicts a bottom view of glove 105 flipped inside out, FIG. 11 depicts a top perspective view of the glove 105 flipped inside out, FIG. 12 depicts a top view of the glove 105 flipped inside out, and FIGS. 13A-13D depict various side views of the glove 105 flipped inside out.

The inner surface of the glove 105 (e.g., the surface that directly receives and contacts the glider 115) can include at least one grip 125. The grip 125 can include at least one material that can grip and/or stick to the second surface 130 of the glider 115 to prevent the glove 105 from moving relative to the glider 115 when the glider 115 is placed in the glove 105. For example, the grip 125 can be formed of various gripping and/or elastomeric materials including, but not limited to, silicone rubber, an adhesive, and/or various other similar materials. The grip 125 can be a different material than the rest of the glove 105.

The grip 125 can include various shapes or sizes at various positions on the inner surface of the glove 105. For example, as depicted throughout the figures, the inside surface of the glove 105 can include a plurality of independent grips 125 forming concentric rings around the center of the glove 105. In some implementations, the grip 125 can include one, monolithic grip that extends in various patterns throughout the inside surface of the glove 105. The one or more grips 125 can include various additional or alternative shape patterns along the inside surface of the glove 105. For example, the one or more grips 125 can extend in a wave-like pattern, a rectangular pattern, an arch pattern, a triangular pattern, a pentagonal pattern, a zig-zag pattern, a serpentine pattern, an asymmetrical pattern, or various other types of shapes or patterns.

The glove 105 and/or the corresponding glider 115 can include various different types of shapes. For example, as depicted throughout the figures, the glider 115 can include a generally round or disc-like shape and the glove 105 can substantially match at least a portion of a profile of the glider 115. The glider 115 and/or glove 105 can include various additional or alternative shapes including, but not limited to, a rectangular shape, an arch shape, a triangular shape, a pentagonal pattern, a hexagonal shape, a heptagonal shape, an asymmetrical shape, or various other shapes.

The glove 105 and/or the corresponding glider 115 can include various sizes. For example, the glider 115 can include a diameter (e.g., width) in the range of 10-30 cm (e.g., 12-25 cm, 15-20 cm, etc.). The glider 115 can include a larger or smaller diameter. For example, the glider 115 can include a diameter that is greater than or equal to 30 cm or less than or equal to 10 cm.

Figure 14:
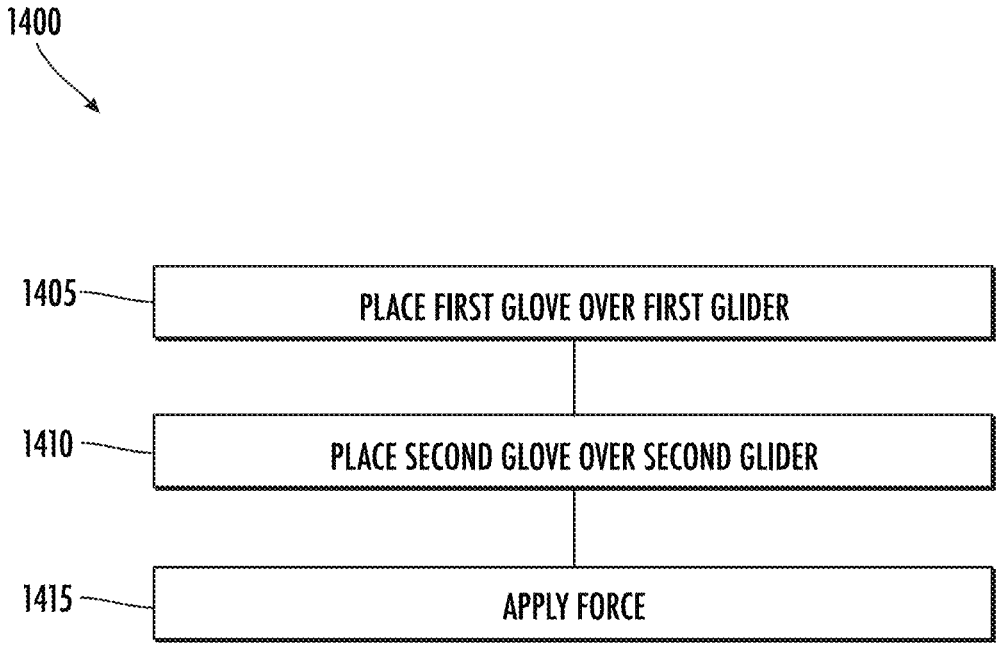
FIG. 14 is an illustration of a method of using the exercise devices of FIG. 1, according to an exemplary embodiment.

FIG. 14 depicts a method 1400 of using one or more of the exercise devices 100. The method 1400 includes placing a first glove 105 on a first glider 115, as depicted in step 1405. For example, an opening 110 of a first glove 105 can expand by the elastic band of opening 110 to receive a first glider 115. Once the first glider 115 is placed into the first glove 105 at the opening 110, the elastic band of the opening 110 can bias the opening 110 towards a center of the opening to at least partially enclose the first glider 115 within the first glove 105. The first glider 115 can be placed in the first glove 105 such that the one or more grips 125 of the first glove 105 engage with (e.g., contact) the second surface 130 of the first glider 115 and such that the first surface 120 of the first glider 115 is at least partially exposed to an exterior of the first glove 105 to engage with (e.g., contact) or portion of a user 90.

The method 1400 includes placing a second glove 105 on a second glider 115, as depicted in step 1410. For example, an opening 110 of a second glove 105 can expand by the elastic band of opening 110 to receive a second glider 115. Once the second glider 115 is placed into the second glove 105 at the opening 110, the elastic band of the opening 110 can bias the opening 110 towards a center of the opening to at least partially enclose the second glider 115 within the second glove 105. The second glider 115 can be placed in the second glove 105 such that the one or more grips 125 of the second glove 105 engage with (e.g., contact) the second surface 130 of the second glider 115 and such that the first surface 120 of the second glider 115 is at least partially exposed to an exterior of the second glove 105 to engage with (e.g., contact) or portion of a user 90.

The method 1400 includes apply a force to at least one of the first glider 115 or the second glider 115, as depicted in step 1415. For example, a user 90 can apply a force to the partially exposed first surface 120 of the first glider 115 or the second glider 115 to cause the corresponding glider 115 and glove 105 to slide or glide along a surface (e.g., a hard flooring surface) by contact between the surface and the outer surface of the glove 105. The one or more grips 125 of the corresponding gliders 115 can facilitate fixing the gloves 105 with the corresponding glider 115 such that a force applied to the glider 115 causes movement of the glider 115 and glove 105 together (e.g., such that the glove 105 does not slide off the glider 115).

Figure 15:
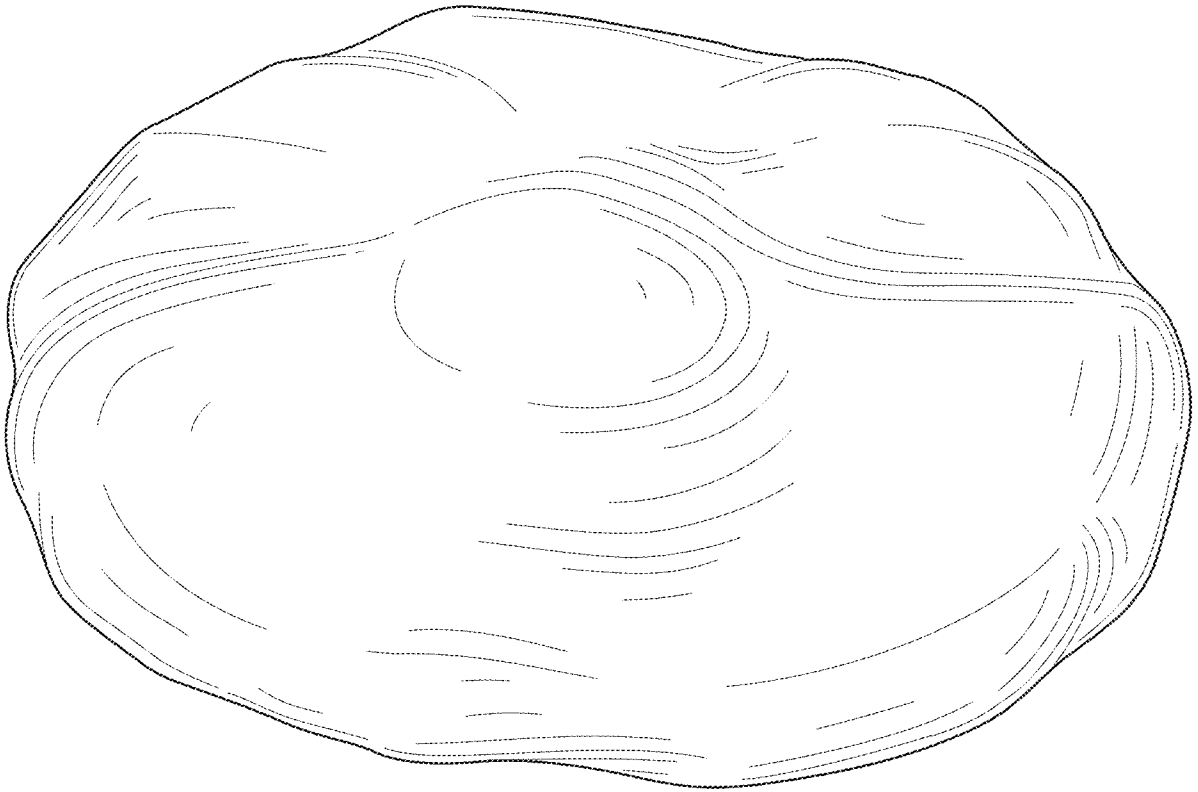
FIGS. 15-28 are illustrations of embodiments of a glove of an exercise device, according to exemplary embodiments.
Figure 16:
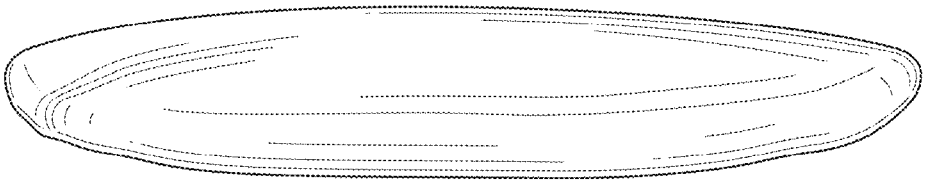
Figure 17:
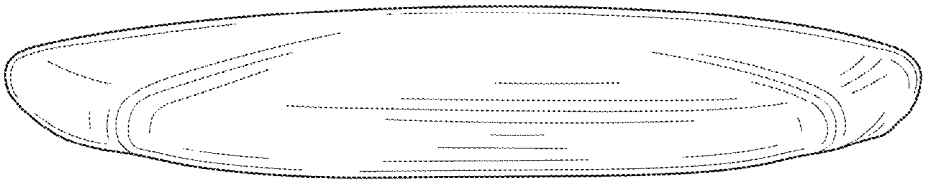
Figure 18:
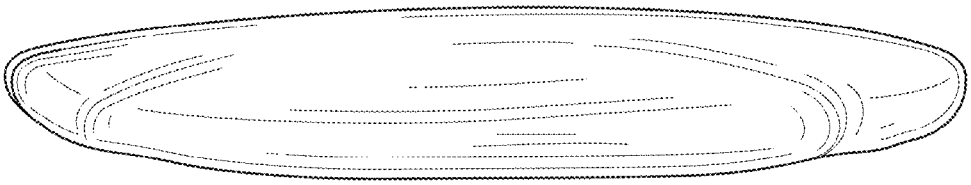
Figure 19:
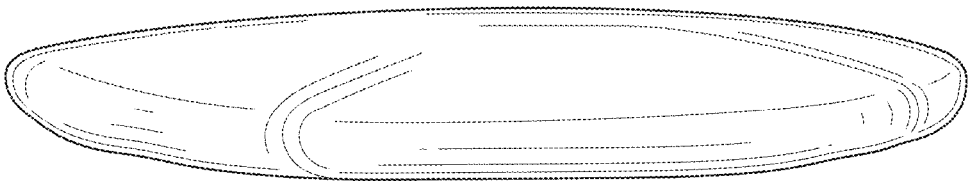
Figure 20:
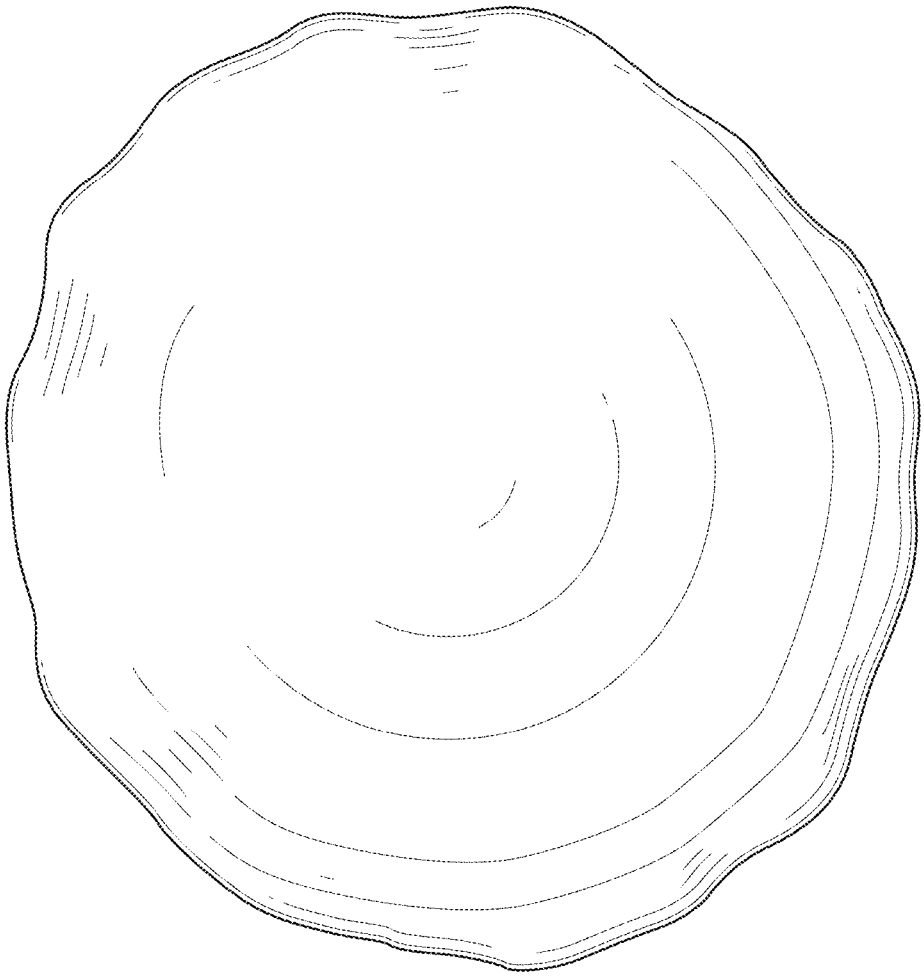
Figure 21:
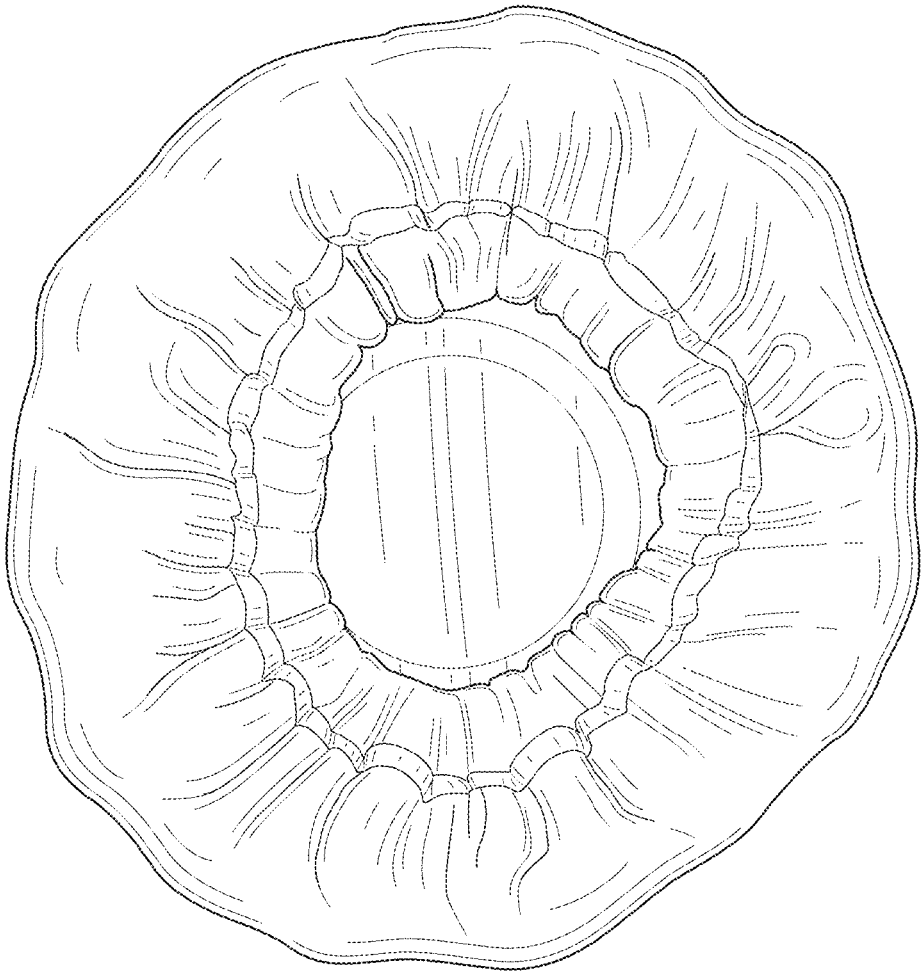
Figure 22:
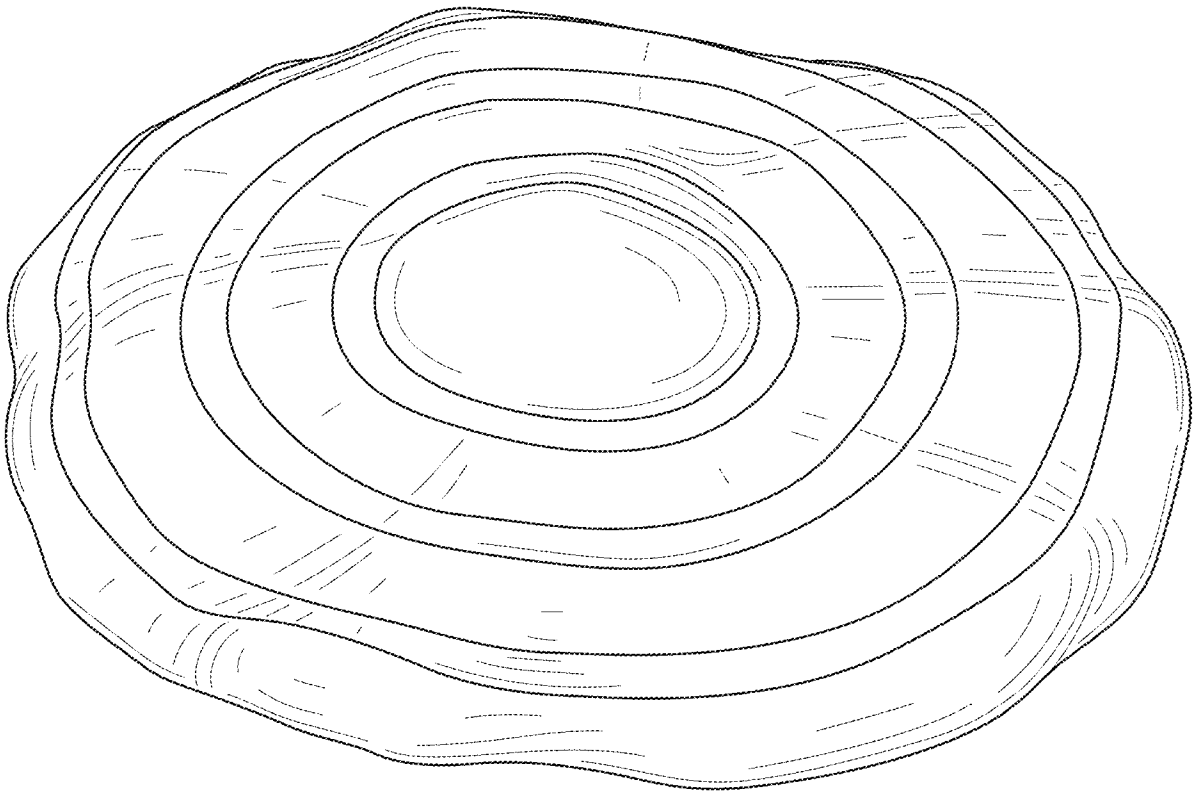
Figure 23:
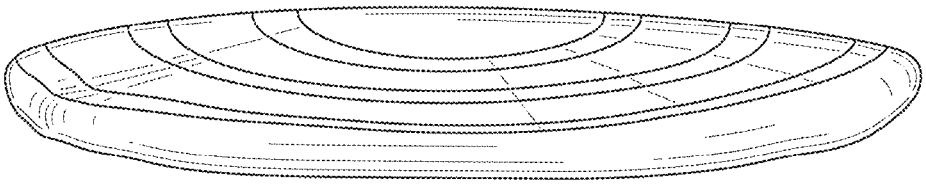
Figure 24:
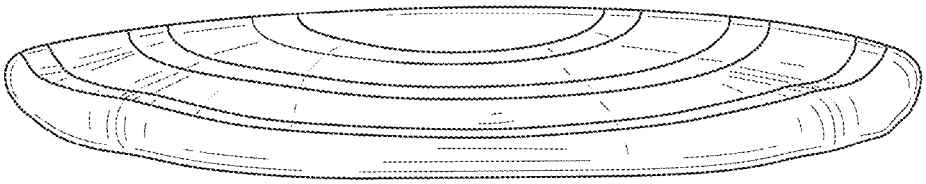
Figure 25:
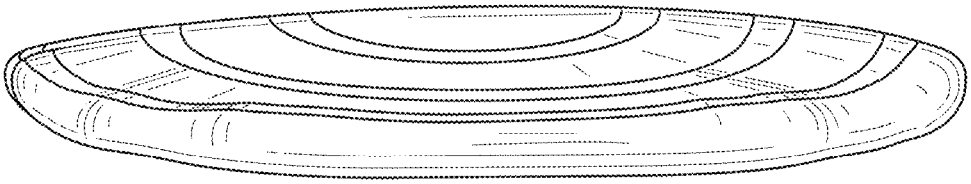
Figure 26:
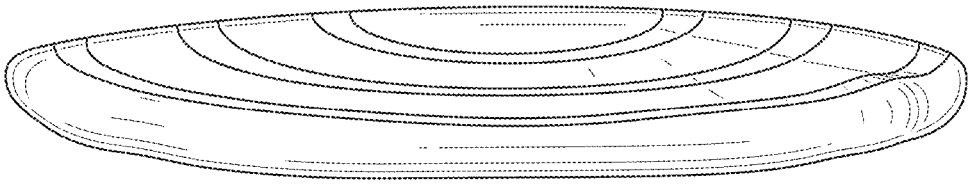
Figure 27:
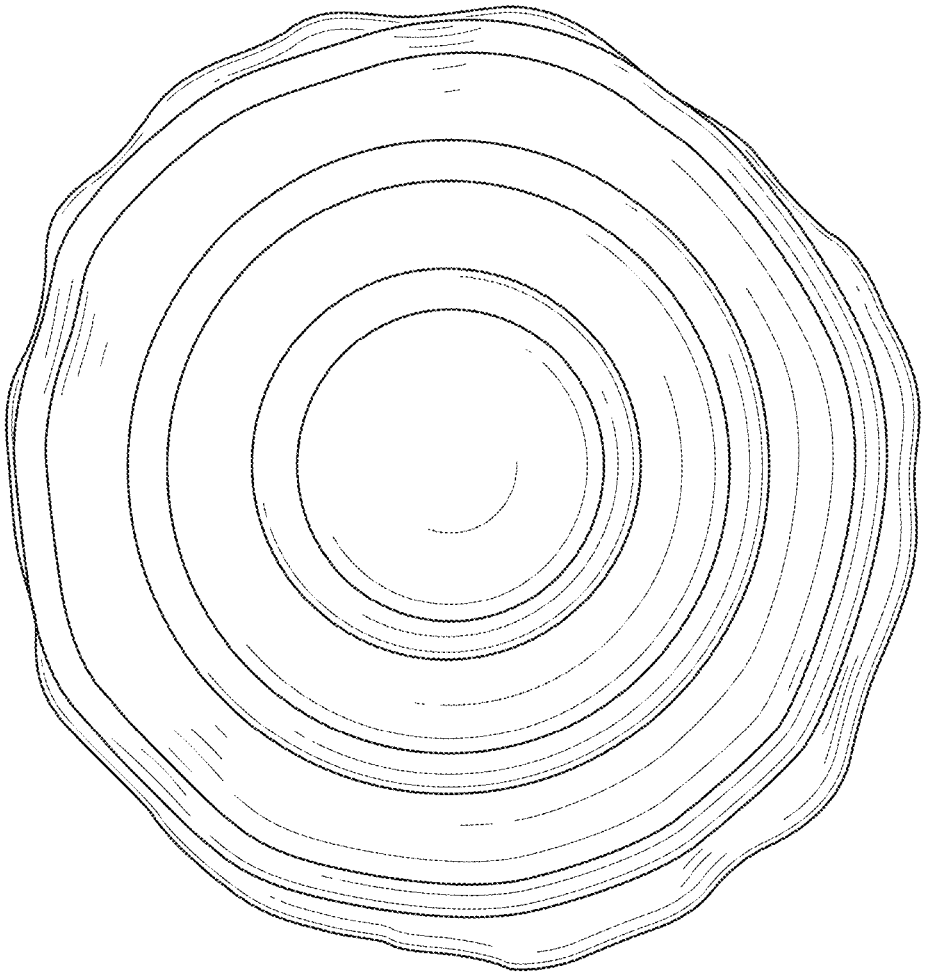
Figure 28:
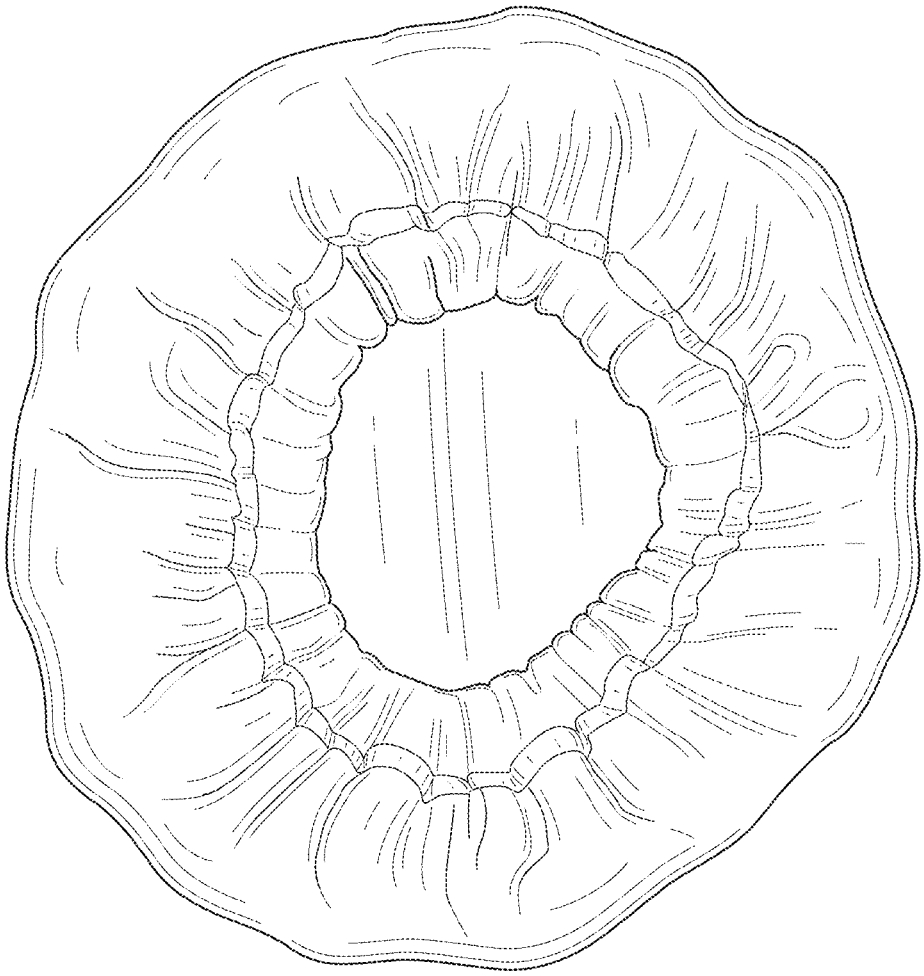

FIGS. 15-28 are illustrations of embodiments of a glove of an exercise device, according to exemplary embodiments. More specifically, FIG. 15 is a bottom perspective view of a glove of an exercise device in a right-side-out state where the glove includes one or more interior grips, FIG. 16 is a front view of the glove in a right-side-out state, FIG. 17 is a rear view of the glove in a right-side-out state, FIG. 18 is a left view of the glove in a right-side-out state, FIG. 19 is a right view of the glove in a right-side-out state, FIG. 20 is a bottom view of the glove in a right-side-out state, and FIG. 21 is a top view of the glove in a right-side-out state. FIG. 22 is a top perspective view of a glove of an exercise device in an inside-out state where the glove includes a plurality of interior grips, FIG. 23 is a front view of the glove in an inside-out state, FIG. 24 is a rear view of the glove in an inside-out state, FIG. 25 is a left view of the glove in an inside-out state, FIG. 26 is a right view of the glove in an inside-out state, FIG. 27 is a top view of the glove in an inside-out state, and FIG. 28 is a bottom view of the glove in an inside-out state.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the Figures. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An exercise device, comprising:

a glider; and a glove configured to cover at least a portion of the glider, the glove comprising a grip disposed on an inner surface of the glove and configured to engage with the glider, wherein the grip is one of a plurality of grips disposed on the inner surface of the glove, and the plurality of grips are disposed in concentric rings around a center of the inner surface of the glove;

wherein the glider and the glove are configured to slide along a surface responsive to a force applied to the glider.

2. The exercise device of claim 1, wherein:

the glider comprises a first material;

the glove comprises a second material; and the second material has a lower coefficient of friction with the surface than the first material.

3. The exercise device of claim 2, wherein the first material comprises a plastic material and the second material comprises a fabric material.

4. The exercise device of claim 1, wherein the grip comprises a silicone rubber material.

5. The exercise device of claim 1, wherein the surface is at least one of a hardwood floor, a vinyl floor, a tile floor, or a laminate floor.

6. The exercise device of claim 1, wherein:

the glove includes an opening having an elastic band;

the opening is configured to receive the glider; and the elastic band is configured to bias the glove around the glider.

7. A glove to cover a glider, the glove comprising:

a grip disposed on an inner surface of the glove, wherein the grip is one of a plurality of grips disposed on the inner surface of the glove, and the plurality of grips are disposed in concentric rings around a center of the inner surface of the glove;

wherein the grip is configured to engage with the glider; and wherein the glider and the glove are configured to slide along a surface responsive to a force applied to the glider.

8. The glove of claim 7, wherein:

the glider comprises a first material;

the glove comprises a second material; and the second material has a lower coefficient of friction with the surface than the first material.

9. The glove of claim 8, wherein the first material comprises a plastic material and the second material comprises a fabric material.

10. The glove of claim 7, wherein the grip comprises a silicone rubber material.

11. The glove of claim 7, wherein the surface is at least one of a hardwood floor, a vinyl floor, a tile floor, or a laminate floor.

12. The glove of claim 7, further comprising:

an opening having an elastic band;

the opening is configured to receive the glider; and the elastic band is configured to bias the glove around the glider.

13. A method of using an exercise device, the method comprising:

providing the exercise device including a first glider, a first glove, a second glider, and a second glove;

wherein the first glove is configured to be fit over the first glider;

wherein the second glove is configured to be fit over the second glider;

wherein at least one of the first glider and the first glove or the second glider and the second glove are configured to be moved along a surface when a force is applied;

wherein the first glove includes a first grip disposed on an inner surface of the first glove to fix the first glider relative to the first glove, the first grip is one of a plurality of grips disposed on the inner surface of the first glove, and the plurality of grips are disposed in concentric rings around a center of the inner surface of the first glove; and wherein the second glove includes a second grip disposed on an inner surface of the second glove to fix the second glider relative to the second glove, the second grip is one of a plurality of grips disposed on the inner surface of the second glove, and the plurality of grips are disposed in concentric rings around a center of the inner surface of the second glove.

14. The method of claim 13, wherein the first grip and the second grip each comprises a silicone rubber material.

15. The method of claim 13, wherein:

the first glider comprises a first material;

the first glove comprises a second material; and the second material has a lower coefficient of friction with the surface than the first material.

16. The method of claim 13, wherein the surface is at least one of a hardwood floor, a vinyl floor, a tile floor, or a laminate floor.

* * * * *